US009614281B2

(12) United States Patent
Peng et al.

(10) Patent No.: US 9,614,281 B2
(45) Date of Patent: Apr. 4, 2017

(54) PHASE ARRAY ANTENNA HAVING A MOVABLE PHASE SHIFTING ELEMENT AND A DIELECTRIC ELEMENT FOR CHANGING THE RELATIVE DIELECTRIC CONSTANT

(71) Applicant: Huawei Technologies Co., Ltd., Shenzhen, Guangdong (CN)

(72) Inventors: Zhongwei Peng, Shenzhen (CN); Zhiqiang Liao, Shenzhen (CN); Shaodong Liu, Shenzhen (CN); Xinming Liu, Xi'an (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 386 days.

(21) Appl. No.: 14/165,336

(22) Filed: Jan. 27, 2014

(65) Prior Publication Data

US 2014/0139401 A1 May 22, 2014

Related U.S. Application Data

(63) Continuation of application No. PCT/CN2012/078116, filed on Jul. 3, 2012.

(30) Foreign Application Priority Data

Jul. 27, 2011 (CN) ..... 2011 1 0212009

(51) Int. Cl.
*H01Q 3/32* (2006.01)
*H01P 1/18* (2006.01)
*H01Q 3/26* (2006.01)

(52) U.S. Cl.
CPC ..... *H01Q 3/32* (2013.01); *H01P 1/184* (2013.01); *H01Q 3/26* (2013.01)

(58) Field of Classification Search
CPC ... H01P 1/18; H01P 1/184; H01P 9/00; H01Q 3/32
(Continued)

(56) References Cited

U.S. PATENT DOCUMENTS 5,801,600 A 9/1998 Butland et al.
6,850,130 B1 2/2005 Gottl et al.
(Continued)

FOREIGN PATENT DOCUMENTS

CN 1134201 A 10/1996
CN 1359548 A 7/2002
(Continued)

*Primary Examiner* — Benny Lee
(74) *Attorney, Agent, or Firm* — Leydig, Voit & Mayer, Ltd.

(57) ABSTRACT

Embodiments of the present invention disclose a phase shifting apparatus, including a first conductor section, a first tapping element, a feeder unit, and a dielectric element, where: the feeder unit is electrically connected to the first tapping element; the first tapping element is electrically connected to the first conductor section; the first tapping element is capable of moving along the first conductor section to change a phase of a signal that flows through the feeder unit, the first tapping element, and the first conductor section; and the dielectric element is disposed at a position near the first conductor section. With the phase shifting apparatus in the embodiments of the present invention, the dielectric element is disposed in order to increase an electrical length of a conductor, which correspondingly reduces a physical length of the conductor, so that the size of the phase shifting apparatus is reduced.

20 Claims, 12 Drawing Sheets

(58) Field of Classification Search
USPC ..... 333/161
See application file for complete search history.

(56) References Cited

U.S. PATENT DOCUMENTS

| | | | |
|---|---|---|---|
| 7,233,217 | B2 | 6/2007 | Phillips et al. |
| 7,301,422 | B2 | 11/2007 | Zimmerman et al. |
| 2005/0146394 | A1 | 7/2005 | Podell |
| 2006/0077098 | A1 | 4/2006 | Zimmerman |
| 2006/0164185 | A1 | 7/2006 | Tae et al. |
| 2008/0024385 | A1 | 1/2008 | Zimmerman |

FOREIGN PATENT DOCUMENTS

| | | | |
|---|---|---|---|
| CN | 1390368 | A | 1/2003 |
| CN | 1853314 | A | 10/2006 |
| CN | 2831460 | Y | 10/2006 |
| CN | 2845197 | Y | 12/2006 |
| CN | 101171719 | A | 4/2008 |
| CN | 201349043 | Y | 11/2009 |
| CN | 101645524 | A | 2/2010 |
| CN | 102263313 | A | 11/2011 |
| EP | 2296224 | A2 | 3/2011 |
| FR | 2930078 | A1 | 10/2009 |
| JP | 2000196302 | A | 7/2000 |
| JP | 3325007 | B2 | 9/2002 |
| JP | 2010135893 | A | 6/2010 |
| WO | WO 0103233 | A1 | 1/2001 |
| WO | WO 0113459 | A1 | 2/2001 |
| WO | WO 2013013565 | A1 | 1/2013 |

PHASE ARRAY ANTENNA HAVING A MOVABLE PHASE SHIFTING ELEMENT AND A DIELECTRIC ELEMENT FOR CHANGING THE RELATIVE DIELECTRIC CONSTANT

CROSS-REFERENCE TO RELATED APPLICATIONS

This application is a continuation of International Patent Application No. PCT/CN2012/078116, filed on Jul. 3, 2012, which claims priority to Chinese Patent Application No. 201110212009.5, filed on Jul. 27, 2011. The afore-mentioned patent applications are hereby incorporated by reference in their entireties.

FIELD OF TECHNOLOGY

Embodiments of the present invention relate to the antenna field, and in particular, to a phase shifting apparatus and an antenna system to which the phase shifting apparatus is applied.

BACKGROUND

A phase shifter is a core component of a remote electrical tilt antenna system of a base station and plays an important role in remote electrical tilting of a directional pattern of the antenna system. By changing a phase of a signal that arrives at an antenna element of the antenna system, the phase shifter implements remote electrical tilting of the directional pattern of the antenna system, and achieves an objective of remotely controlling and adjusting a network coverage area under different circumstances. In an implementation process of the present invention, the inventor finds that an existing phase shifting apparatus is large in size, which does not meet a current miniaturization trend of an antenna system; in addition, the inventor further finds that a power allocation feature of an existing phase shifter does not meet a user needs.

SUMMARY OF THE INVENTION

An embodiment of the present invention provides a small-sized phase shifting apparatus and an antenna system that uses the phase shifting apparatus.

An embodiment of the present invention further provides a phase shifting apparatus that has a good power allocation feature and an antenna system that uses the phase shifting apparatus.

A phase shifting apparatus includes a first conductor section, a first tapping element, a feeder unit, and a dielectric element, where: the feeder unit is electrically connected to the first tapping element; the first tapping element is electrically connected to the first conductor section; the first tapping element is capable of moving along the first conductor section to change a phase of a signal that flows through the feeder unit, the first tapping element, and the first conductor section; and the dielectric element is disposed at a position near the first conductor section and is configured to change a relative dielectric constant near the first conductor section in order to increase an electrical length of the first conductor section.

An antenna system includes a phase shifting apparatus and radiating units that are electrically connected to the phase shifting apparatus, where the phase shifting apparatus includes a first conductor section, a first tapping element, a feeder unit, and a dielectric element, where: the feeder unit is electrically connected to the first tapping element; the first tapping element is electrically connected to the first conductor section; the first tapping element is capable of moving along the first conductor section to change a phase of a signal that flows through the feeder unit, the first tapping element, and the first conductor section; the dielectric element is disposed at a position near the first conductor section and is configured to change a relative dielectric constant near the first conductor section in order to increase an electrical length of the first conductor section; the first conductor section includes electrical connecting ends that are located on two opposite sides of an electrical connecting area of the first tapping element and the first conductor section; and the radiating units are separately connected to the electrical connecting ends of the first conductor section.

With the phase shifting apparatus and the antenna system that uses the phase shifting apparatus provided in the embodiments of the present invention, an dielectric element is disposed at a periphery, namely, an adjacent position, of the first conductor section in the phase shifting apparatus or the antenna system that uses the phase shifting apparatus, and the dielectric element is capable of changing the relative dielectric constant near the first conductor section in order to increase the electrical length of the first conductor section. In the embodiments of the present invention, the dielectric element is used to increase the relative dielectric constant near the first conductor section in order to increase the electrical length of the first conductor section. Therefore, in the case that the electrical length is the same, a required physical length of the first conductor section may be shortened correspondingly, thereby miniaturizing the phase shifting apparatus.

A phase shifting apparatus includes a first conductor section, a first tapping element, and a feeder unit, where: the feeder unit is electrically connected to the first tapping element; the first tapping element is electrically connected to the first conductor section; the first conductor section includes a first coupling area and first connecting areas that are located at two opposite ends of the first coupling area, where a first slideway is formed in the first coupling area of the first conductor section, and the first slideway extends from a connecting position between the first coupling area and one of the first connecting areas to a connecting position between the first coupling area and the other first connecting area along the first coupling area; and a part at which the first tapping element is electrically connected to the first conductor section is located inside the first slideway.

An antenna system includes the preceding phase shifting apparatus, radiating units, and a reflecting plate, where the radiating units are electrically connected to two output ends of the first conductor section, and the phase shifting apparatus and the radiating units are separately disposed on the reflecting plate.

With the phase shifting apparatus and the antenna system that uses the phase shifting apparatus provided in the embodiments of the present invention, a first slideway is disposed on the first conductor section, and the part at which the first tapping element is electrically connected to the first conductor section is contained in the first slideway, so that a moving position of the first tapping element is precisely limited and a good power allocation feature may be obtained.

DETAILED DESCRIPTION OF THE INVENTION

Figure 1:
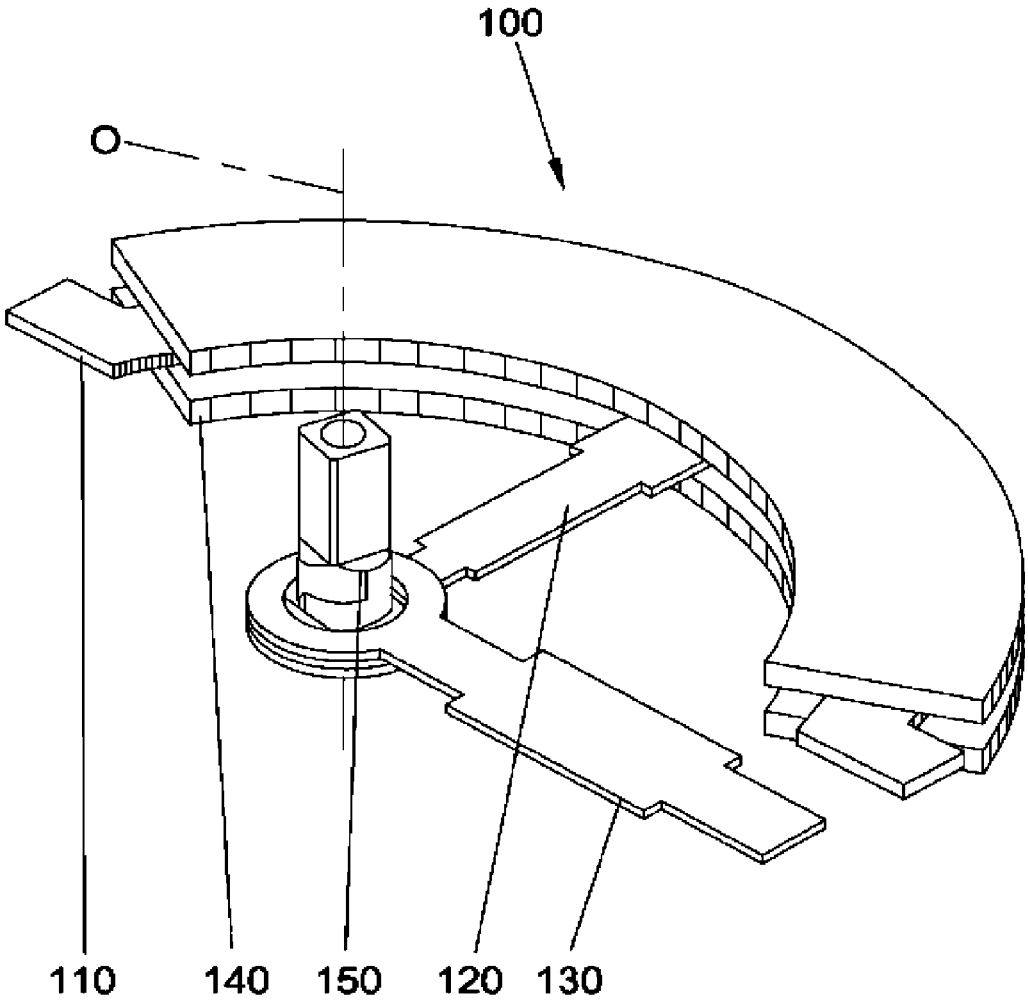
FIG. 1 is a three-dimensional schematic diagram of a phase shifting apparatus according to an embodiment of the present invention.
Figure 2:
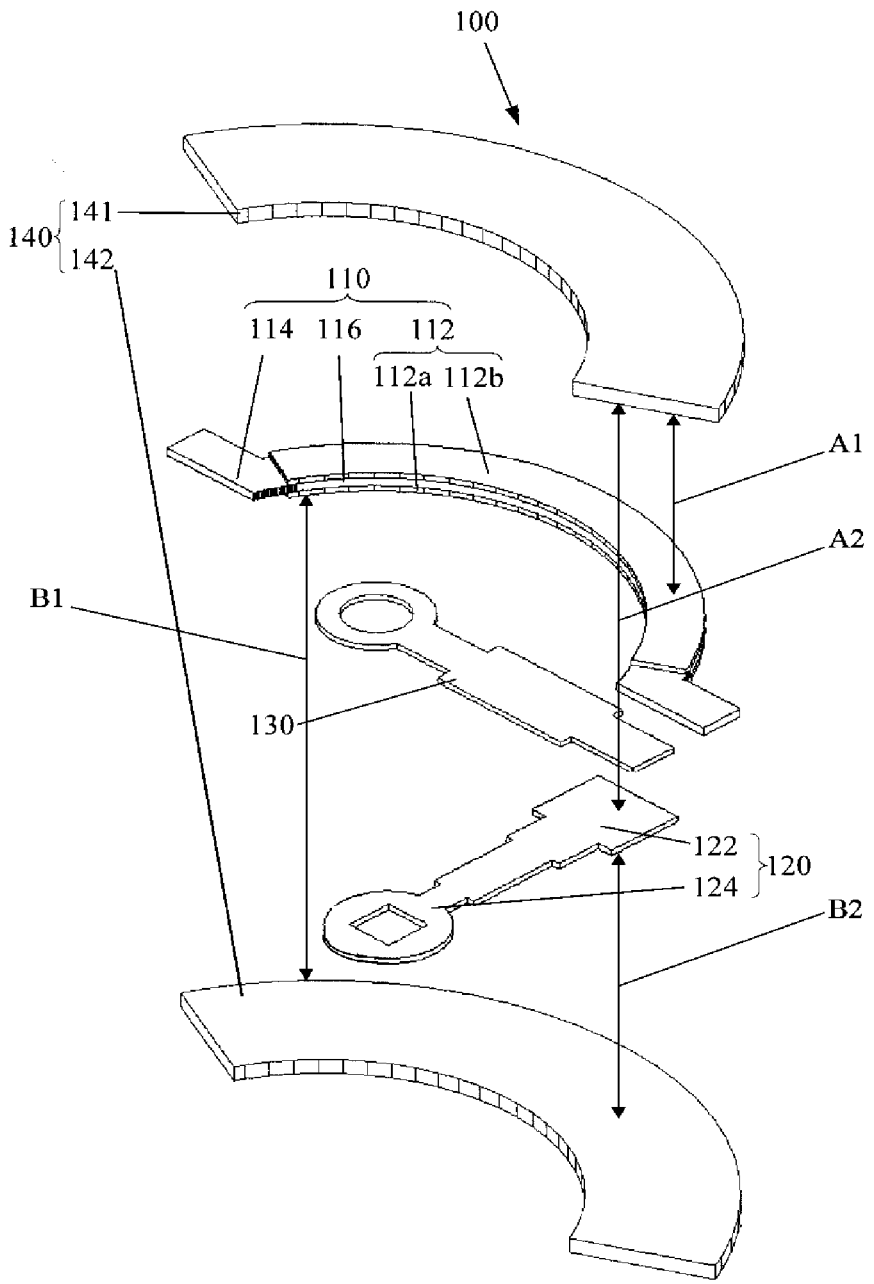
FIG. 2 is a schematic diagram showing an exploded view of the phase shifting apparatus according to FIG. 1.

Referring to FIG. 1 and FIG. 2, the present invention provides a phase shifting apparatus 100, including a first conductor section 110, a first tapping element 120, a feeder unit 130, and a dielectric element 140. The feeder unit 130 is electrically connected to the first tapping element 120; the first tapping element 120 is electrically connected to the first conductor section 110; the first tapping element 120 is capable of moving along the first conductor section 110 to change a phase of a signal that flows through the feeder unit 130, the first tapping element 120, and the first conductor section 110; and the dielectric element 140 is disposed at a position near the first conductor section 110 and is configured to change a relative dielectric constant near the first conductor section 110 in order to increase an electrical length of the first conductor section 110. It is understandable that definitive ordinal numbers "first", "second", and "third" adopted in the following embodiments of the present invention are distinguishing wordings used to clearly describe similar features in the present invention and do not represent the arrangement order or the use order of corresponding features.

The first conductor section 110 is configured to transmit a signal. In the embodiment, the first conductor section 110 is in a strip shape, and the transmitted signal may be input through the first tapping element 120 to the first conductor section 110 from any position between two opposite ends of the first conductor section 110 and output from the two opposite ends of the first conductor section 110. In the embodiment, the conductor section should be understood as any conductor that is capable of transmitting a signal. In the embodiment, the first conductor section 110 is in a strip arc shape, and correspondingly, the first tapping element 120 may be disposed along a diameter of the arc of the first conductor section 110, and may be designed into a structure with which the first tapping element 120 is capable of rotating around the center of a rotation axis, so that the first tapping element 120 moves along the first conductor section 110 by rotating. Further, to enable the first tapping element 120 to rotate around the center O of the rotation axis, the phase shifting apparatus 100 may further include a rotation axis 150 (FIG. 1). The rotation axis 150 is disposed at the center O of the rotation axis of the first tapping element 120. The first tapping element 120 is disposed on the rotation axis 150 and is capable of rotating around the rotation axis 150 or rotating under driving of the rotation axis 150. When the first tapping element 120 is disposed on the rotation axis 150, the first tapping element 120 hinged on the rotation axis 150 may be directly driven through a driving apparatus (not shown in the figure), so that the first tapping element 120 rotates around the rotation axis 150, thereby changing its position that is relative to the first conductor section 110; or the rotation axis 150 is directly driven through the driving apparatus (not shown in the figure), so that the rotation axis 150 drives the first tapping element 120 that is disposed on the rotation axis 150 to rotate. It is understandable that the first conductor section 110 is not limited in the arc shape specified in the embodiment, and may be designed into various different shapes according to specific requirements, for example, a line shape, a curve shape, and a spiral shape. A moving manner of the first tapping element 120 is not limited to rotating around the rotation axis specified in the embodiment, and may be designed differently according to different shapes of the first conductor section 110.

Further, to precisely control a moving position of the first tapping element 120 and improve reliability of an electrical connection between the first conductor section 110 and the first tapping element 120 and a power allocation feature, a containing space for containing the first tapping element 120 may be set on the first conductor section 110, so that the first tapping element 120 moves within the containing space of the first conductor section 110, thereby ensuring that positions of the first tapping element 120 and the first conductor section 110 can keep relatively stable. Specifically, as shown in FIG. 2 the first conductor section 110 includes a first coupling area 112 and first connecting areas 114 that are located at two opposite ends of the first coupling area 112; a first slideway 116 is formed in the first coupling area 112 of the first conductor section 110; the first slideway 116 extends from a connecting position between the first coupling area 112 and one of the first connecting areas 114 to a connecting position between the first coupling area 112 and the other first connecting area 114 along the first coupling area 112; and a part at which the first tapping element 120 is electrically connected to the first conductor section 110 is located inside the first slideway 116. To improve manufacturability of the first conductor section 110 and adaptability of the first tapping element 120, the first slideway 116 may be set to run through the first coupling area 112 along an extension direction of a connecting line between the center of the rotation axis of the first tapping element 120 and the furthest rotation position of the first tapping element. Optionally, the first coupling area 112 includes a first coupling piece 112*a* and a second coupling piece 112*b*; the first coupling piece 112*a* and the second coupling piece 112*b* are disposed at an interval and are connected to the first connecting areas 114 through their respective two opposite ends; the first slideway 116 is formed between the first coupling piece 112*a* and the second coupling piece 112*b*; and the first tapping element 120 is electrically connected to the first coupling piece 112*a* and the second coupling piece 112*b*. Further, the electrical connection between the first tapping element 120 and the first conductor section 110 is implemented in an electrical coupling manner. More specifically, the electrical connection between the first tapping element 120 and the first conductor section 110 provided in the embodiment of the present invention is insulation coupling, where the insulation coupling may specifically be adding an insulation layer between the first tapping element 120 and the first conductor section 110. The insulation layer may be a plastic slice or an insulation coating that is covered on corresponding surfaces of the first tapping element 120 and the first conductor section 110.

The tapping element 120 includes a coupling part 122 and a supporting part 124. The coupling part 122 is electrically connected to the first conductor section 110. One end of the supporting part 124 is connected to the coupling part 122, and the other end of the supporting part 124 is disposed on the rotation axis 150 (FIG. 1). When the supporting part 124 is made of conductive material such as metal, conductive plastic, and conductive ceramic, one end of the supporting part 124, which is away from the end that is connected to the coupling part 122, may be electrically connected to the feeder unit 130 to establish a signal transmission channel between the coupling part 122 and the feeder unit 130. Optionally, if the supporting part 124 is made of nonconductive material such as polyethylene and insulation ceramic, the feeder unit 130 may also be electrically connected to the coupling part 122 directly, instead of being connected via the supporting part 124. A shape of the coupling part 122 may be set according to a requirement. The shape may be a plate shape, and may also be a tuning fork shape formed by two parallel plates leading from the supporting part.

The feeder element 130 is configured to transmit a signal. In the embodiment, the feeder element 130 is in a flake shape, that is a flat and broad shape, and the feeder element 130 is electrically connected to the supporting part 124 of the first tapping element 120 to achieve an objective of establishing a signal channel between the feeder element 130 and the coupling part 122. Optionally, the feeder element 130 may be a flexible conductive wire, and is electrically connected to the coupling part 122 of the first tapping element 120 directly, that is, when the supporting part 124 of the first tapping element 120 is made of nonconductive material and only the coupling part 122 is made of conductive material, the feeder element 130 may be designed as a flexible conductive wire with a certain redundant length, and an electrical connection between the feeder element 130 and the coupling part 122 of the first tapping element 120 is implemented through the flexible conductive wire. The electrical connection, in a broad sense, refers to transmission of an electrical signal through contact of a conductor and transmission of an electrical signal through electrical coupling of the conductor.

A dielectric element 140 (FIGS. 1 and 2) is made of material whose relative dielectric constant is different from a relative dielectric constant of air, that is, the relative dielectric constant of the dielectric element 140 is not equal to 1. In the embodiment, the relative dielectric constant of the dielectric element 140 is greater than 1, and the dielectric element 140 is disposed at a position near the first conductor section 110, for example, is disposed above the first conductor section 110 or below the first conductor section 110, where for "above" and "below" in the foregoing, reference is made to the first conductor section 110 that is horizontally placed. The relative dielectric constant of the dielectric element 140 is different from the relative dielectric constant of air around the first conductor section 110, and a relative dielectric constant of the environment around the first conductor section 110 affects an electrical length of the first conductor section 110. The electrical length is obtained by multiplying a physical length of the first conductor section 110 by a ratio of time for transmitting an electrical or electromagnetic wave signal in the first conductor section 110 (marked as t1) to time for transmitting the electrical or electromagnetic wave signal in a free space with a distance that is equal to the length of the first conductor section 110 (marked as t2), that is, (electrical length=physical length*t1/t2), or it may also be considered that the electrical length is equal to a ratio of the physical length to an operating wavelength of an electromagnetic wave. Disposing a dielectric element at a position that is closest enough to the first conductor section 110 may significantly affect the electrical length of the first conductor section 110. Therefore, the electrical length of the first conductor section 110 can be increased when a dielectric element whose relative dielectric constant is greater than 1 is disposed either above or below the first conductor section 110. In the case of the same electrical length requirement, the physical length of the first conductor section 110 can be shortened, thereby achieving an objective of miniaturizing the phase shifter. After the dielectric element 140 is added, in the case of the same electrical length requirement, a change of the length of the first conductor section 110 may be approximately expressed by the following formula. An approximate formula for expressing a change of an arc length after a dielectric is added is $L1=L0/\sqrt{\in}$, where, L1 indicates a length of the first conductor section 110, where the length is a length that is affected by the dielectric element 140 in the case of the same electrical length requirement, L0 indicates a length of the first conductor section 110, where the length is a length that is not affected by the dielectric element 140 in the case of the same electrical length requirement, and $\in$ indicates the relative dielectric constant of the dielectric element 140. It should be noted that due to the air, in an actual condition, $\in$ in the formula is smaller than $\in$ of dielectric material itself.

Specifically, as shown in FIG. 2 in the embodiment, the dielectric element 140 includes a first dielectric layer 141 and a second dielectric layer 142; the first dielectric layer 141 and the second dielectric layer 142 are disposed at an interval; and an electrical connecting area of the first conductor section 110 and the first tapping element 120 is sandwiched between the first dielectric layer 141 and the second dielectric layer 142. Further, a gap A1 is formed between the first dielectric layer 141 and the adjacent first conductor section 110 or a gap A2 is formed between the first dielectric layer 141 and the first tapping element 120; and a gap B1 is formed between the second first dielectric layer 142 and the adjacent first conductor section 110 or a gap B2 is formed between the second dielectric layer 142 and the first tapping element 120. By using the gap, the electrical connection between the first tapping element 120 and the first conductor section 110 is not affected, and an electrical connection feature between the first tapping element 120 and the first conductor section 110 is improved. Still further, shapes of the first dielectric layer 141 and the second dielectric layer 142 are similar to the shape of the first conductor section 110, which are both an arc shape in the embodiment. Further, the thickness of the first dielectric layer 141 and the second dielectric layer 142 in a direction that is vertical to a moving plane of the tapping element 120 may be selected within a range of 0.5 mm to 5 mm. Further, the first dielectric layer 141 and the second dielectric layer 142 are made of material whose relative dielectric constant is within a range of 1.5 to 16.

Herein, transmission of a signal is taken as an example for description. A process of receiving a signal is similar to a process of transmitting a signal. The feeder unit 130 receives a signal sent from a signal source, where the signal source is usually a base station. The feeder unit 130 transmits the received signal to the first tapping element 120, and the first tapping element 120 transmits the signal to the first conductor section 110 in an electrical coupling manner, and then the signal is output from two ends of the first conductor section 110. When the first tapping element 120 moves along the first conductor section 110, a position of the electrical connecting area of the first conductor section 110 and the first tapping element 120 will change, and correspondingly, a distance between the position of the electrical connecting area and the two ends, namely, signal output ends, of the first conductor section 110 will change, and therefore, a transmission distance of the signal output from the two ends of the first conductor section 110 will change. Because a change of the transmission distance may cause that a phase of the output signal changes, an objective of phase shifting is achieved. Due to the presence of the dielectric element 140, a relative dielectric constant around the first conductor section 110 changes. In the embodiment, the relative dielectric constant around the first conductor section 110 is increased through the dielectric element 140 in order to increase the electrical length of the first conductor section 110. The physical length of the first conductor section 110 is definite, but its electrical length changes according to the relative dielectric constant of the environment. Therefore, in the embodiment of the present invention, the dielectric element 140 is used to increase the electrical length of the first conductor section 110. Therefore, in the case that the electrical length is the same, a required physical length of the first conductor section 110 is shortened, thereby achieving an objective of reducing the size of the phase shifter 100.

With the phase shifting apparatus 100 provided in the embodiment of the present invention, a dielectric element 140 is disposed at a periphery, namely, an adjacent position, of the first conductor section 110 in the phase shifting apparatus 100, and the dielectric element 140 is capable of changing the relative dielectric constant near the first conductor section 110 in order to increase the electrical length of the first conductor section 110. In the embodiment of the present invention, the dielectric element is used to increase the relative dielectric constant near the first conductor section 110 in order to increase the electrical length of the first conductor section 110. Therefore, in the case that the electrical length is the same, a required physical length of the first conductor section 110 may be shortened correspondingly, thereby miniaturizing the phase shifting apparatus.

Figure 3:
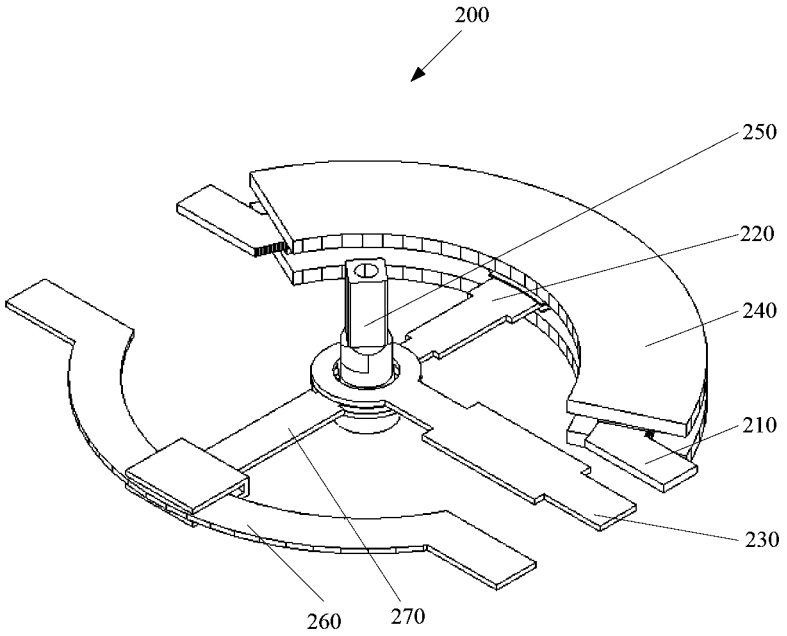
FIG. 3 is a three-dimensional schematic diagram of a phase shifting apparatus according to another embodiment of the present invention.

Referring to FIG. 3, another embodiment of the present invention provides a phase shifting apparatus 200. A structure of the phase shifting apparatus 200 is similar to a structure of the phase shifting apparatus 100 of FIGS. 1 and 2. The phase shifting apparatus 200 includes a first conductor section 210, a first tapping element 220, a feeder unit 230, and a dielectric element 240. For ease of understanding, elements that have a similar/same structure in each embodiment of the present invention are uniformly marked by using similar mark numbers, for example, both 110 and 210 are used to represent the first conductor section, and for brevity, the elements that have a similar/same structure will not be described repeatedly or specially illustrated hereinafter. The phase shifting apparatus 200 differs from the phase shifting apparatus 100 in that the phase shifting apparatus 200 further includes a second conductor section 260 and a second tapping element 270, where: the feeder unit 230 is electrically connected to the second tapping element 270; the second tapping element 270 is electrically connected to the second conductor section 260; the second tapping element 270 is capable of moving along the second conductor section 260 to change a phase of a signal that flows through the feeder unit 230, the second tapping element 270, and the second conductor section 260; and the second tapping element 270 implements synchronous moving with the first tapping element 220 through a synchronization apparatus, and moving paths of the second tapping element 270 and the first tapping element 220 do not interfere with each other.

In the embodiment, the first conductor section 210 and the second conductor section 260 are both in a strip arc shape; the first tapping element 220 rotates around the center of a rotation axis to move along the first conductor section 210; and the second tapping element 270 rotates around the center of another rotation axis to move along the second conductor section 260. In the embodiment, the first tapping element 220 and the second tapping element 270 both rotate around the center of a rotation axis to implement moving, so that a driving structure of the first tapping element 220 and the second tapping element 270 may be simplified.

Specifically, the center of a rotation axis of the first tapping element 220 may coincide with the center of a rotation axis of the second tapping element 270. In other words, the first tapping element 220 and the second tapping element 270 rotate around the center of the same rotation axis. In this case, the synchronization apparatus is a rotation axis 250 that is disposed at the center of the rotation axis of the first tapping element 220 and the second tapping element 270; and the first tapping element 220 and the second tapping element 270 are disposed on the rotation axis 250 and are capable of rotating around the rotation axis 250 or rotating under driving of the rotation axis 250. This disposing manner may simplify a driving apparatus that drives the first tapping element 220 and the second tapping element 270 to move, in order to simplify a structure of the phase shifter and reduce the cost.

Further, according to a specific requirement, it may be set that the first tapping element 220 and the second tapping element 270 that are disposed on the same rotation axis 250 rotate on the same rotation plane, or it may be set that the first tapping element 220 and the second tapping element 270 that are disposed on the same rotation axis 250 rotate on different rotation planes.

Figure 3A:
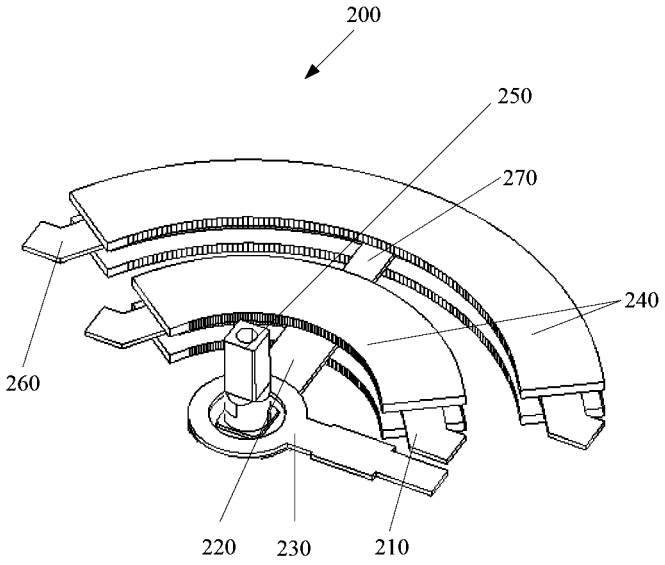
FIG. 3A illustrates another embodiment of the phase shifting apparatus according to FIG. 3.

Specifically, if it is set that the first tapping element 220 and the second tapping element 270 rotate on the same rotation plane, the same rotation plane is vertical to the rotation axis 250. Correspondingly, the first conductor section 210 and the second conductor section 260 are also disposed on the same plane, the first tapping element 220 and the second tapping element 270 are fixedly connected to each other, and a certain angle exists between a projection of the first tapping element 220 and a projection of the second tapping element 270 on the plane that is vertical to the center of the rotation axis. In the embodiment, an angle of 180 degrees exists between the projection of the first tapping element 220 and the projection of the second tapping element 270 on the plane that is vertical to the center of the rotation axis. It is understandable that the angle between the projection of the first tapping element 220 and the projection of the second tapping element 270 on the plane that is vertical to the rotation axis may change randomly within a range of 0 degrees to 180 degrees according to a requirement, which is not limited in the embodiment. In the embodiment, the first tapping element 220 and the second tapping element 270 are fixedly connected to each other at a position near the rotation axis, an axial hole 271 is formed at the position at which the first tapping element 220 and the second tapping element 270 are fixedly connected, and the first tapping element 220 and the second tapping element 270 are disposed on the rotation axis 250 through the axial hole 271. Further, the position for connecting the first tapping element 220 and the second tapping element 270 may be selected randomly according to a requirement. For example, the first tapping element 220 is disposed on the rotation axis, and one end of the second tapping element 270 is disposed at any position between the first tapping element 220 and the first conductor section 210, or as shown in FIG. 3A, the second tapping element 270 is disposed at one end where the first tapping element 220 is electrically connected to the first conductor section 210, and the second conductor section 260 is electrically connected to one end of the second tapping element 270, where the end of the second tapping element 270 is away from the first tapping element 220, or vice versa. Optionally, the second conductor section 260 is parallel to the first conductor section 210 and at a certain distance from the first conductor section 210. Optionally, the dielectric element 240 may also be disposed on two opposite sides of the second conductor section 260.

Figure 4:
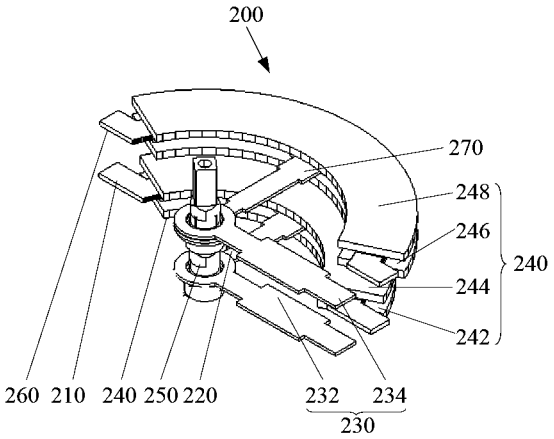
FIG. 4 illustrates another embodiment of the phase shifting apparatus according to FIG. 3.

Specifically, referring to FIG. 4, if it is set that the first tapping element 220 and the second tapping element 270 rotate on different planes, correspondingly, the first conductor section 210 and the second conductor section 260 are disposed at an interval along an axis direction of the rotation axis 250; the first tapping element 220 and the second tapping element 270, which correspond to the first conductor section 210 and the second conductor section 260 respectively, are disposed at an interval along the axial direction of the rotation axis 250; and the feeder unit 230 includes a first feeder element 232 and a second feeder element 234, where the first feeder element 232 is electrically connected to the first tapping element 220, and the second feeder element 234 is electrically connected to the second tapping element 270. It is understandable that because the first conductor section 210 and the second conductor section 260 are disposed at an interval along the axial direction of the rotation axis 250 and the first tapping element 220 and the second tapping element 270 are also disposed at an interval along the axial direction of the rotation axis 250, the first tapping element 220 and the second tapping element 270 may be disposed randomly within a circle without interfering with each other in terms of positions, where the center of the rotation axis 250 is used as the center of the circle. In the embodiment, to save a space, a projection of the first conductor section 210 and a projection of the first tapping element 220 along an extension direction of an axial line of the rotation axis overlap a projection of the second conductor section 260 and a projection of the second tapping element 270 along the same direction. In this way, a horizontal space occupied when the first conductor section 210, the first tapping element 220, the second conductor section 260, and the second tapping element 270 are placed horizontally (and the rotation axis is placed vertically) is reduced.

Figure 5:
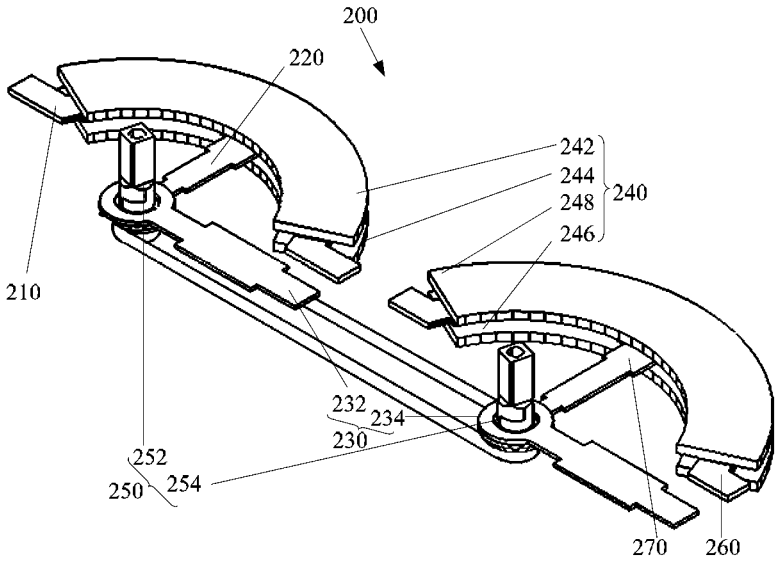
FIG. 5 illustrates another embodiment of the phase shifting apparatus according to FIG. 3.

Referring to FIG. 5, optionally, the center of the rotation axis of the first tapping element 220 and the center of the rotation axis of the second tapping element 270 are disposed at an interval, and in this case, the phase shifting apparatus 200 further includes a first rotation axis 252 that is disposed at the center of the rotation axis of the first tapping element 220, and a second rotation axis 254 that is disposed at the center of the rotation axis of the second tapping element 270, where: the first tapping element 220 is disposed on the first rotation axis 252 and is capable of rotating around the first rotation axis 252 or rotating under driving of the first rotation axis 252; the second tapping element 270 is disposed on the second rotation axis 254 and is capable of rotating around the second rotation axis 254 or rotating under driving of the second rotation axis 254; and the synchronization apparatus (not shown in the figure) is disposed between the first rotation axis 252 and the second rotation axis 254 to enable the first tapping element 220 and the second tapping element 270 to rotate synchronously, or to enable the first rotation axis 252 and the second rotation axis 254 to rotate synchronously in order to drive the first tapping element 220 and the second tapping element 270 to rotate synchronously. Correspondingly, the feeder unit 230 includes a first feeder element 232 and a second feeder element 234, where the first feeder element 232 is electrically connected to the first tapping element 220, and the second feeder element 234 is electrically connected to the second tapping element 270.

Figure 6:
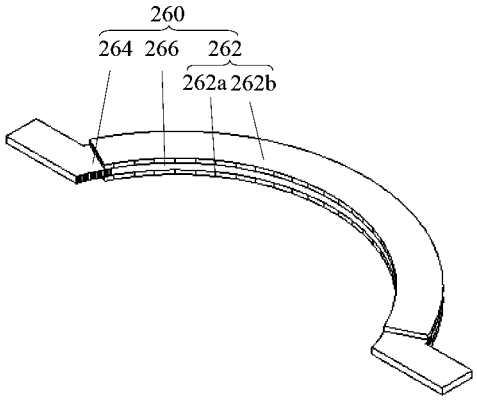
FIG. 6 is a schematic diagram of a second conductor section of the phase shifting apparatus according to FIG. 3.

Further, referring to FIG. 6, in the embodiment, the second conductor section 260 includes a second coupling area 262 and second connecting areas 264 that are located at two opposite ends of the second coupling area 262; a second slideway 266 is formed in the second coupling area 262 of the second conductor section 260; the second slideway 266 extends from a connecting position between the second coupling area 262 and one of the second connecting areas 264 to a connecting position between the second coupling area 262 and the other second connecting area 264 along the second coupling area 262; and a part at which the second tapping element 270 (FIGS. 3, 3A, 4, 4A, and 5) is electrically connected to the second conductor section 260 is located inside the second slideway 266. To improve manufacturability of the second conductor section 260 and adaptability of the second tapping element 270, the second slideway 266 runs through the second coupling area 262 along an extension direction of a connecting line between the center of the rotation axis of the second tapping element 270 and the second tapping element 270. Optionally, the second coupling area 262 includes a third coupling piece 262*a* and a fourth coupling piece 262*b*; the third coupling piece 262*a* and the fourth coupling piece 262*b* are disposed at an interval and are connected to the second connecting areas 264 through their respective two opposite ends; the second slideway 266 is formed between the third coupling piece 262*a* and the fourth coupling piece 262*b*; and the second tapping element 270 is electrically connected to the third coupling piece 262*a* and the fourth coupling piece 262*b*.

Further, still referring to FIG. 5, the dielectric element 240 includes a first dielectric layer 242 and a second dielectric layer 244; the first dielectric layer 242 and the second dielectric layer 244 are disposed at an interval; and an electrical connecting area of the first conductor section 210 and the first tapping element 220 is sandwiched between the first dielectric layer 242 and the second dielectric layer 244.

Further, the dielectric element 240 further includes a third dielectric layer 246 and a fourth dielectric layer 248; the third dielectric layer 246 and the fourth dielectric layer 248 are disposed at an interval; and an electrical connecting area of the second conductor section 260 and the second tapping element 270 is sandwiched between the third dielectric layer 246 and the fourth dielectric layer 248. A gap is formed between the first dielectric layer 242 and the second dielectric layer 244 and the adjacent first conductor section 210 or the first tapping element 220; and a gap is formed between the third dielectric layer 246 and the fourth dielectric layer 248 and the adjacent second conductor section 260 or the second tapping element 270.

Further, shapes of the first dielectric layer 242 and the second dielectric layer 244 are similar to a shape of the first conductor section 210, and shapes of the third dielectric layer 246 and the fourth dielectric layer 248 are similar to a shape of the second conductor section 260. By adopting a conductor section and dielectric layer whose shapes are similar, an electrical length of the conductor section may be effectively changed without affecting electrical performance of other elements. Further, the thickness of the first dielectric layer 242 and the second dielectric layer 244 in a direction that is vertical to a moving plane of the tapping element may change within a range of 0.5 mm to 5 mm, and the thickness of the third dielectric layer 246 and the fourth dielectric layer 248 in a direction that is vertical to a moving plane of the tapping element may change within the range of 0.5 mm to 5 mm. Further, the material of the first dielectric layer, the second dielectric layer, the third dielectric layer, and the fourth dielectric layer is polyetherimide (Polyetherimide, PEI) or poly-p-phenylene oxide (poly-p-phenylene oxide, PPO).

With the phase shifting apparatus 200 provided in the present invention, a combination of the first conductor section 210 and the second conductor section 260 is used, and the dielectric element 240 is disposed at a periphery, namely, an adjacent position, of the first conductor section 210 and/or the second conductor section 260, where the dielectric element 240 is capable of changing a relative dielectric constant near the first conductor section 210 and/or the second conductor section 260 in order to change an electrical length of the first conductor section 210 and/or the second conductor section 260. In the embodiment of the present invention, the dielectric element is used to increase the relative dielectric constant near the first conductor section 210 and/or the second conductor section 260 in order to increase the electrical length of the first conductor section 210 and/or the second conductor section 260. Therefore, in the case that the electrical length is the same, a required physical length of the first conductor section 210 and/or the second conductor section 260 may be shortened, thereby achieving an objective of miniaturizing the phase shifting apparatus 200.

Figure 7:
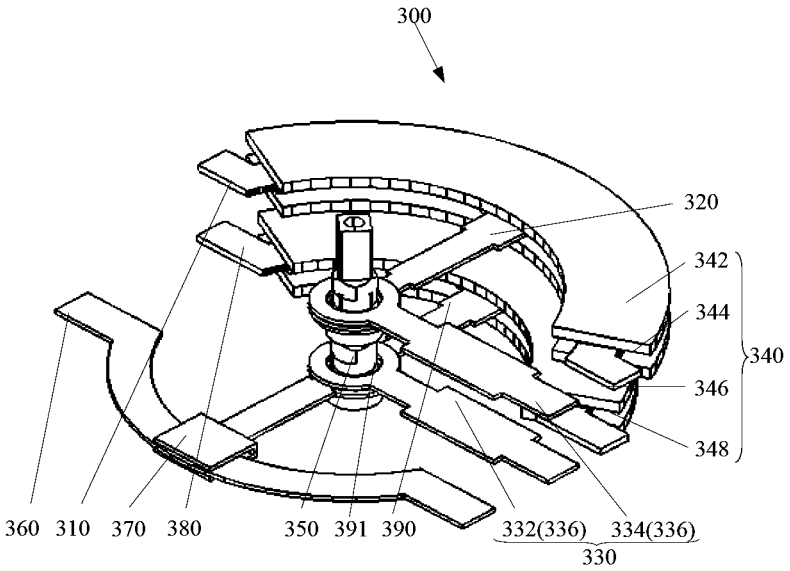
FIG. 7 is a three-dimensional schematic diagram of a phase shifting apparatus according to another embodiment of the present invention.

Referring to FIG. 7, another embodiment of the present invention provides a phase shifting apparatus 300. A structure of the phase shifting apparatus 300 is similar to the structure of the phase shifting apparatus 200 as shown in FIGS. 3, 3A, 4, 4A and 5. The phase shifting apparatus 300 includes a first conductor section 310, a first tapping element 320, a feeder unit 330, and a dielectric element 340, consisting of a first dielectric layer 342, a second dielectric layer 344, a third dielectric layer 346, and a fourth dielectric layer 348, a second conductor section 360, and a second tapping element 370. The phase shifting apparatus 300 differs from the phase shifting apparatus 200 in that the phase shifting apparatus 300 further includes a third conductor section 380 and a third tapping element 390, where: the feeder unit 330 is also electrically connected to the third tapping element 390; the third tapping element 390 is electrically connected to the third conductor section 380; the third tapping element 390 is capable of moving along the third conductor section 380 to change a phase of a signal that flows through the feeder unit 330, the third tapping element 390, and the third conductor section 380; and the third tapping element 390 implements synchronous moving with the first tapping element 320 and the second tapping element 370 through a synchronization apparatus, and moving paths of the third tapping element 390, the second tapping element 370, and the first tapping element 320 do not interfere with each other. A position relationship between the first tapping element 320 and the corresponding first conductor section 310 and a position relationship between the second tapping element 370 and the corresponding second conductor section 360 may be the same as a position relationship between the first tapping element 220 and the corresponding first conductor section 210 and a position relationship between the second tapping element 270 and the corresponding second conductor section 260 in the phase shifting apparatus 200. No repeated description is provided herein.

Further, the third conductor section 380 is in a strip arc shape, and the third tapping element 390 rotates around the center of a rotation axis of the first tapping element 320 or the center of a rotation axis of the second tapping element 370 to move along the third conductor section 380. To reduce the size of the entire phase shifter 300, the third conductor section 380 is designed in a strip arc shape, and at the same time, the third tapping element 390 has the same center of the rotation axis as that of the first tapping element 320 or the second tapping element 370. Therefore, the third tapping element 390 may be disposed on the same driving apparatus (not shown in the figure) with the first tapping element 320 or the second tapping element 370 to reduce the number of required driving apparatuses, so as to achieve an objective of reducing the size of the entire phase shifter 300.

Further, the center of the rotation axis of the first tapping element 320 coincides with the center of the rotation axis of the second tapping element 370; the synchronization apparatus is a rotation axis 350 that is disposed at the center of the rotation axis of the first tapping element 320 and the second tapping element 370; and the first tapping element 320, the second tapping element 370, and the third tapping element 390 are disposed on the rotation axis 350 and are capable of rotating around the rotation axis 350 or rotating under driving of the rotation axis 350. With this disposing manner, the first tapping element 320, the second tapping element 370, and the third tapping element 390 may rotate around the same rotation axis 350, and each of the tapping elements can be driven by one driving apparatus or a few driving apparatuses, so that the structure is further simplified.

Figure 7A:
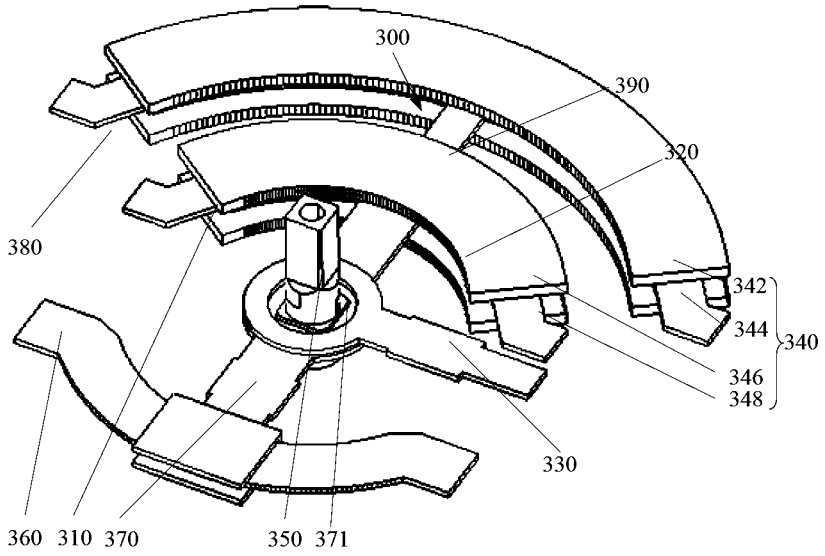
FIG. 7A illustrates another embodiment of the phase shifting apparatus according to FIG. 7.
Figure 8:
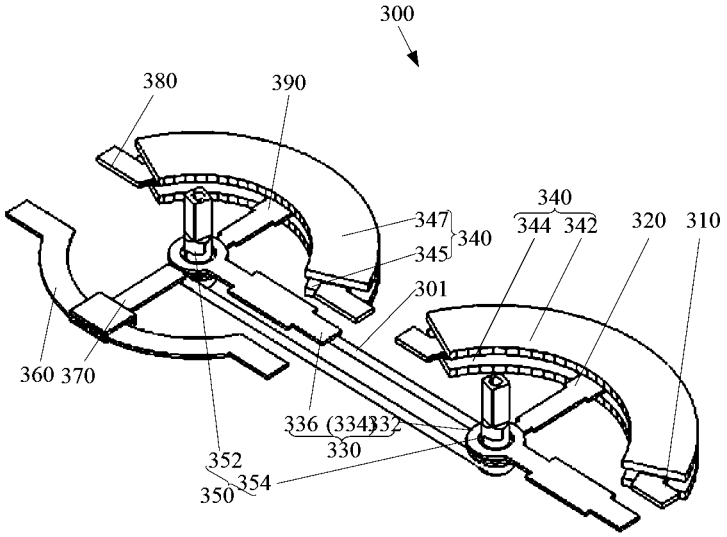
FIG. 8 illustrates another embodiment of the phase shifting apparatus according to FIG. 7.

Further, when the first tapping element 320, the second tapping element 370, and the third tapping element 390 are disposed on the same rotation axis 350, a position relationship among the three may be randomly set according to a requirement. Specifically, the first conductor section 310 and the second conductor section 360 may be disposed at an interval along an axial direction of the rotation axis 350, or disposed on the same plane along the axial direction of the rotation axis 350. Optionally, the first tapping element 320 and the second tapping element 370, which correspond to the first conductor section 310 and the second conductor section 360 respectively, are disposed at an interval along the axial direction of the rotation axis 350; the third conductor section 380 is disposed on the same plane with the first conductor section 310 or the second conductor section 360; and the third tapping element 390, which corresponds to the third conductor section 380, is disposed on the same plane with the first tapping element 320 or the second tapping element 370. Correspondingly, the feeder unit 330 includes a first feeder element 332, a second feeder element 334, and a third feeder element 336, where the first feeder element 332 is electrically connected to the first tapping element 320, the second feeder element 334 is electrically connected to the second tapping element 370, and the third feeder element 336 is electrically connected to the third tapping element 390. Optionally, a projection of the first conductor section 310 and a projection of the first tapping element 320 along an extension direction of an axial line of the rotation axis 350 overlap a projection of the second conductor section 360 and a projection of the second tapping element 370 along the same direction or overlap a projection of the third conductor section 380 and a projection of the third tapping element 390 along the same direction, where the third conductor section 380 and the third tapping element 390 are on the same plane with the second conductor section 360 and the second tapping element 370. Optionally, the first tapping element 320 and the third tapping element 390 or the second tapping element 370 and the third tapping element 390 are fixedly connected to each other, and a certain angle exists between a projection of the first tapping element 320 and a projection of the third tapping element 390 that is connected to the first tapping element 320 or between a projection of the second tapping element 370 and the projection of the third tapping element 390 that is connected to the second tapping element 370 on a plane that is vertical to the center of the rotation axis. In the embodiment, an angle of 180 degrees exists between the projection of the first tapping element 320 and the projection of the third tapping element 390 on the plane that is vertical to the center of the rotation axis; or an angle of 180 degrees exists between the projection of the second tapping element 370 and the projection of the third tapping element 390 on the plane that is vertical to the center of the rotation axis. Optionally, when the first tapping element 320 and the third tapping element 390 are fixedly connected to each other at a position near the rotation axis 350, an axial hole 391 is formed at the position at which the first tapping element 320 and the third tapping element 390 are fixedly connected, and the first tapping element 320 and the third tapping element 390 are disposed on the rotation axis 350 through the axial hole 391. Optionally, when the second tapping element 370 and the third tapping element 390 are fixedly connected to each other at a position near the rotation axis 350, an axial hole 391 is formed at the position at which the second tapping element 370 and the third tapping element 390 are fixedly connected, and the second tapping element 370 and the third tapping element 390 are disposed on the rotation axis 350 through the axial hole 391. Optionally, referring to FIG. 7A, the first tapping element 320 and the second tapping element 370 are disposed on the same plane along the axial direction of the rotation axis 350; the third conductor section 380, the first conductor section 310, and the second conductor section 360 are all disposed on the same plane, and the third tapping element 390, which corresponds to the third conductor section 380, is disposed on the same plane with the first tapping element 320 and the second tapping element 370; and correspondingly, the first conductor section 310, the second conductor section 360, and the third conductor section 380 are electrically connected to the same feeder unit 330. The first dielectric layer 342, the second dielectric layer 344, the third dielectric layer 346, and the fourth dielectric layer 348, of the dielectric element 340 are also illustrated in FIG. 7A. Optionally, the first tapping element 320 and the second tapping element 370 are fixedly connected to each other, an axial hole 371 is formed at a position at which the first tapping element 320 and the second tapping element 370 are fixedly connected, and the first tapping element 320 and the second tapping element 370 are disposed on the rotation axis 350 through the axial hole 371. The third tapping element 390 is disposed at one end where the first tapping element 320 is electrically connected to the first conductor section 310; and the third conductor section 380 is electrically connected to one end of the third tapping element 390, where the end of the third tapping element 390 is away from the first tapping element 320. Optionally, the third conductor section 380 is parallel to the first conductor section 310 and at a certain distance from the first conductor section 310. Optionally, in the same or similar way in which the first conductor section 310 and the first tapping element 320 are connected to each other, the third conductor section 380 and the third tapping element 390 are connected to each other, and the second conductor section 360 and the second tapping element 370 are connected to each other. Optionally, referring to FIG. 8, the center of the rotation axis of the first tapping element 320 and the center of the rotation axis of the second tapping element 370 are disposed at an interval, and the phase shifting apparatus 300 further includes a first rotation axis 352 that is disposed at the center of the rotation axis of the first tapping element 320, and a second rotation axis 354 that is disposed at the center of the rotation axis of the second tapping element 370, where: the first tapping element 320 is disposed on the first rotation axis 352 and is capable of rotating around the first rotation axis 352 or rotating under driving of the first rotation axis 352; and the second tapping element 370 is disposed on the second rotation axis 354 and is capable of rotating around the second rotation axis 354 or rotating under driving of the second rotation axis 354. In the embodiment, the third tapping element 390 is disposed on the first rotation axis 352 and is capable of rotating around the first rotation axis or rotating under driving of the first rotation axis. The first dielectric layer 342 and the second dielectric layer 344 of the dielectric element 340 are also illustrated in FIG. 8. A synchronization apparatus 301 is disposed between the first rotation axis 352 and the second rotation axis 354 to enable the first tapping element 320, the second tapping element 370, and the third tapping element 390 to rotate synchronously or to enable the first rotation axis 352 and the second rotation axis 354 to rotate synchronously in order to drive the first tapping element 320, the second tapping element 370, and the third tapping element 390 to rotate synchronously. The feeder unit 330 includes a first feeder element 332, a second feeder element 334, and a third feeder element 336, where the first feeder element 332 is electrically connected to the first tapping element 320, the second feeder element 334 is electrically connected to the second tapping element 370, and the third feeder element 336 is electrically connected to the third tapping element 390. It is understandable that: when the first tapping element 320 is fixedly connected to the third tapping element 390, the first feeder element 332 is the same as the third feeder element 336; and when the second tapping element 370 is fixedly connected to the third tapping element 390, the second feeder element 334 is the same as the third feeder element 336. In other words, the feeder unit 330 in the foregoing embodiment may include only the first feeder element 332 and the second feeder element 334, where the first feeder element 332 is configured to, among the first tapping element 320, the second tapping element 370, and the third tapping element 390, electrically connect the first tapping element 320 and the second tapping element 370 that are fixedly connected to each other or electrically connect the second tapping element 370 and the third tapping element 390 that are fixedly connected to each other, and correspondingly, the second feeder element 334 is electrically connected to the third tapping element 390 or the first tapping element 320, where the third tapping element 390 or first tapping element 320 is separately-disposed among the first tapping element 320, the second tapping element 370, and the third tapping element 390. The separate disposition refers to a tapping element disposed separately from tapping elements that are fixedly connected to each other among the first tapping element 320, the second tapping element 370, and the third tapping element 390.

In the embodiment, specific structures and disposing manners of the first conductor section 310, the second conductor section 360, the first tapping element 320, and the second tapping element 370 are the same as those of corresponding elements in the phase shifting apparatuses 100 and 200, which are not described repeatedly herein. The third conductor section 380 and the third tapping element 390 are further described in the following.

Figure 9:
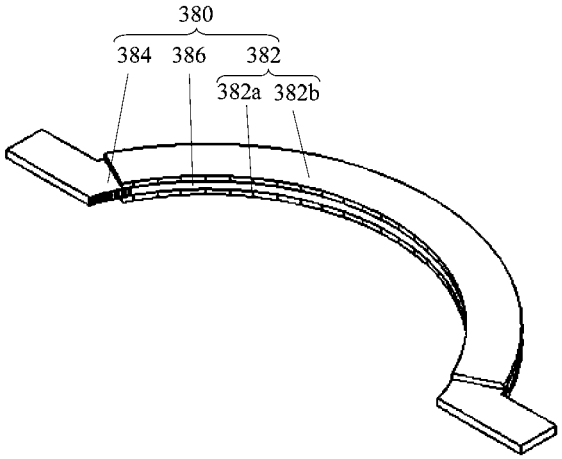
FIG. 9 illustrates another embodiment of the phase shifting apparatus according to FIG. 7.

Referring to FIG. 9, the third conductor section 380 includes a third coupling area 382 and third connecting areas 384 that are located at two opposite ends of the third coupling area 382; a third slideway 386 is formed in the third coupling area 382 of the third conductor section 380; the third slideway 386 extends from a connecting position between the third coupling area 382 and one of the third connecting areas 384 to a connecting position between the third coupling area 382 and the other third connecting area 384 along the third coupling area 382; and a part at which the third tapping element 390 is electrically connected to the third conductor section 380 is located inside the third slideway 386. Further, the third slideway 386 runs through the third coupling area 382 along an extension direction of a connecting line between the center of the rotation axis of the third tapping element 390 and the third tapping element 390.

Optionally, the third slideway 386 may also be formed by two coupling pieces that are disposed at an interval. Specifically, the third coupling area 382 includes a fifth coupling piece 382*a* and a sixth coupling piece 382*b*; the fifth coupling piece 382*a* and the sixth coupling piece 382*b* are disposed at an interval and are connected to the third connecting areas 384 through their respective two opposite ends; the third slideway 386 is formed between the fifth coupling piece 382*a* and the sixth coupling piece 382*b*; and the third tapping element 390 is electrically connected to the fifth coupling piece 382*a* and the sixth coupling piece 382*b*.

Further, still referring to FIG. 8, the dielectric element 340 further includes a fifth dielectric layer 345 and a sixth dielectric layer 347; the fifth dielectric layer 345 and the sixth dielectric layer 347 are disposed at an interval; and an electrical connecting area of the third conductor section 380 and the third tapping element 390 is sandwiched between the fifth dielectric layer 345 and the sixth dielectric layer 347. Shapes of the fifth dielectric layer 345 and the sixth dielectric layer 347 are the same as a shape of the third conductor section 380. In addition, a gap is formed between the fifth dielectric layer 345 and the sixth dielectric layer 347 and the adjacent third conductor section 380 or the third tapping element 390. The thickness of the fifth dielectric layer 345 and the sixth dielectric layer 347 in a direction that is vertical to a moving plane of the tapping element is 0.5 mm to 5 mm. The fifth dielectric layer 345 and the sixth dielectric layer 347 are made of material whose relative dielectric constant is within a range of 1.5 to 16.

Figure 10:
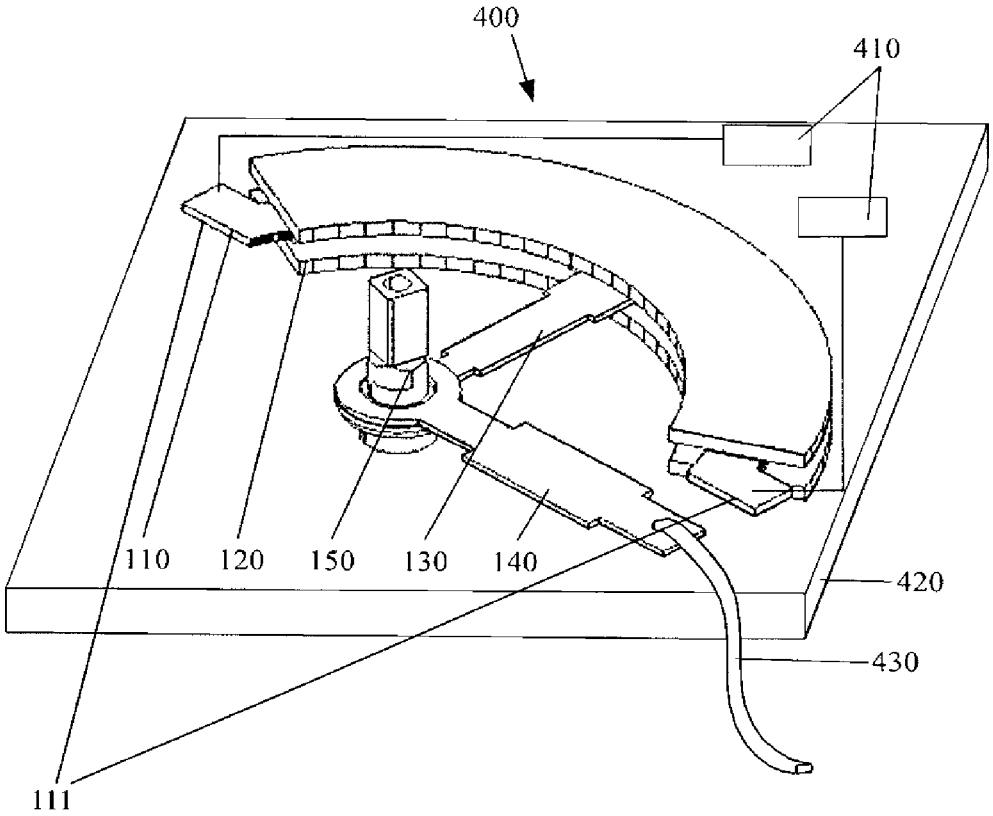
FIG. 10 is a three-dimensional schematic diagram of an antenna system according to an embodiment of the present invention.

Referring to FIG. 10, an embodiment of the present invention provides an antenna system 400. The antenna system includes a phase shifting apparatus and radiating units 410 that are electrically connected to the phase shifting apparatus. For a specific structure of the phase shifting apparatus, reference may be made to specific structures of the phase shifting apparatuses 100 (FIGS. 1 and 2), 200 (FIGS. 3, 3A, 4, 4A and 5), and 300 (FIGS. 7, 7A and 8) provided in the embodiments of the present invention. For brevity, only the phase shifting apparatus 100 is taken as an example to describe a structure of the antenna system 400. It is understandable that, the other phase shifting apparatuses 200 and 300 are also applicable to the antenna system 400 in the embodiment in a manner that is similar to that of the phase shifting apparatus 100.

In addition to the specific structure of the phase shifting apparatus 100 disclosed in the foregoing embodiment, it should further be noted that the first conductor section 110 includes electrical connecting ends 111 that are located on two opposite sides of an electrical connecting area of the first conductor section 110 and the first tapping element 120 as shown in FIGS. 1 and 2. In the embodiment, the electrical connecting ends 111 are two opposite ends of the first conductor section 110. The radiating units 410 (FIG. 10) are connected to each of the electrical connecting ends 111 of the first conductor section 110.

Further, the antenna system 400 further includes a reflector plate 420, where the phase shifting apparatus 400 and the radiating units 410 are disposed on the reflector plate 420.

Further, the antenna system 400 further includes a feeder network 430. The feeder network 430 is electrically connected to the feeder unit 130 to perform signal transmission. Specifically, the feeder network 430 is connected between a base station unit and the feeder element 130, and is configured to transmit, to the feeder unit 130, a signal that is sent by the base station; the feeder unit 130 transmits the signal to the first conductor section 110 through the tapping element 120; the signal is output through the two ends of the first conductor section 110 to the radiating units 410 that are connected to the first conductor section 110, and then the signal is radiated to the environment by the radiating units 410 in the form of an electromagnetic wave.

Figure 11:
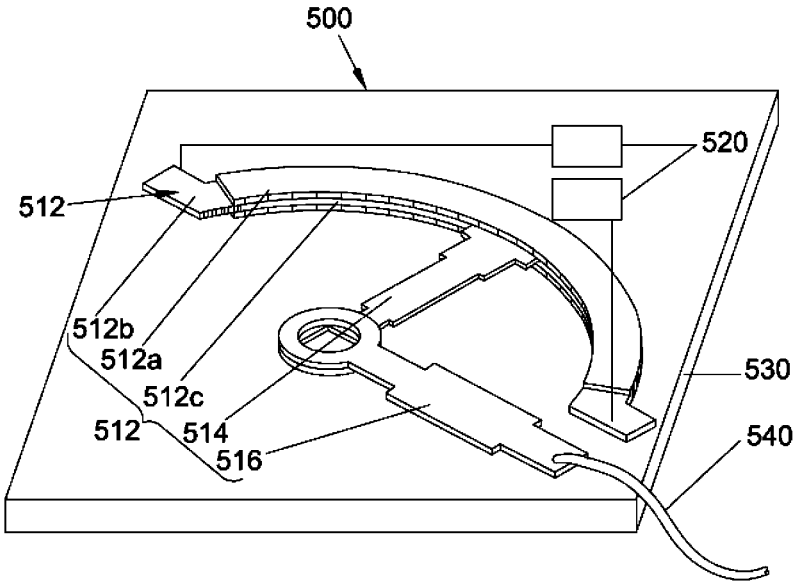
FIG. 11 is a three-dimensional schematic diagram of an antenna system according to another embodiment of the present invention.

Referring to FIG. 11, an embodiment of the present invention provides an antenna system 500, including a phase shifting apparatus 510, radiating units 520, and a reflector plate 530. The phase shifting apparatus 510 includes a first conductor section 512, a first tapping element 514, and a feeder unit 516. The feeder unit 516 is electrically connected to the first tapping element 514; the first tapping element 514 is electrically connected to the first conductor section 512; the first conductor section 512 includes a first coupling area 512*a* and first connecting areas 512*b* that are located at two opposite ends of the first coupling area; a first slideway 512*c* is formed in the first coupling area 512*a* of the first conductor section 512; the first slideway 512*c* extends from a connecting position between the first coupling area 512*a* and one of the first connecting areas 512*b* to a connecting position between the first coupling area 512*a* and the other first connecting area 512*b* along the first coupling area 512*a*; a part at which the first tapping element 514 is electrically connected to the first conductor section 512 is located inside the first slideway 512*c*; the radiating units 520 are electrically connected to two output ends of the first conductor section 512; and the phase shifting apparatus 510 and the radiating units 520 are disposed on the reflector plate 530. Further, the antenna system 500 further includes a feeder network 540, where the feeder network 540 and the feeder unit 516 are electrically connected to perform signal transmission.

It is understandable that the phase shifting apparatus 510 adopted in the antenna system 500 in the embodiment of the present invention may be replaced with the phase shifting apparatus 100, 200, or 300 provided in the embodiments of the present invention. A difference between the antenna system 400 and the antenna system 500 that adopts the phase shifting apparatus 100, 200, or 300 provided in the embodiments of the present invention lies in that the dielectric element may be removed when the phase shifting apparatus 100, 200, or 300 is applied in the antenna system 500.

Finally, it should be noted that the foregoing embodiments are merely intended for describing the technical solutions of the present invention rather than limiting the present invention. Although the present invention is described in detail with reference to the foregoing embodiments, persons of ordinary skill in the art should understand that they can still make modifications to the technical solutions described in the foregoing embodiments or make equivalent substitutions to some technical features of the technical solutions, as long as these modifications or substitutions do not cause the essence of corresponding technical solutions to depart from the spirit and scope of the technical solutions of the embodiments of the present invention.

What is claimed is:

1. A phase shifting apparatus comprising:

a first conductor section, a first tapping element, a feeder unit, and a dielectric element, wherein the feeder unit is electrically connected to the first tapping element;

the first tapping element is electrically connected to the first conductor section;

the first tapping element is capable of adapted for moving along the first conductor section to change a phase of a signal that flows through the feeder unit, the first tapping element, and the first conductor section; and the dielectric element is disposed at a position near the first conductor section and is configured to change a relative dielectric constant near the first conductor section in order to increase an electrical length of the first conductor section; and the first conductor section and the first tapping element are disposed on a same side of the dielectric element.

2. The phase shifting apparatus according to claim 1, wherein the first conductor section is in a strip arc shape, and the first tapping element rotates around a rotation axis to move along the first conductor section.

3. The phase shifting apparatus according to claim 2, further comprising a rotation axis, wherein the rotation axis is disposed at the center of the rotation axis of the first tapping element, and the first tapping element is disposed on the rotation axis and is capable of rotating around the rotation axis or rotating under driving of the rotation axis.

4. The phase shifting apparatus according to claim 2, wherein:

the first conductor section comprises a first coupling area and first connecting areas that are located at two opposite ends of the first coupling area; and wherein a first slideway is formed in the first coupling area of the first conductor section;

the first slideway extends from a connecting position between the first coupling area and one of the first connecting areas to a connecting position between the first coupling area and the other first connecting areas along the first coupling area; and a part at which the first tapping element is electrically connected to the first conductor section is located inside the first slideway.

5. The phase shifting apparatus according to claim 4, wherein the first slideway runs through the first coupling area along an extension direction of a connecting line between the center of the rotation axis of the first tapping element and the furthest rotational position of the first tapping element.

6. The phase shifting apparatus according to claim 4, wherein: the first coupling area comprises a first coupling piece and a second coupling piece;

the first coupling piece and the second coupling piece are disposed at an interval and are connected to the first connecting areas through their respective two opposite ends;

the first slideway is formed between the first coupling piece and the second coupling piece; and the first tapping element is electrically connected to the first coupling piece and the second coupling piece.

7. The phase shifting apparatus according to claim 1, wherein: the dielectric element comprises a first dielectric layer and a second dielectric layer;

the first dielectric layer and the second dielectric layer are disposed at an interval; and an electrical connecting area of the first conductor section and the first tapping element is sandwiched between the first dielectric layer and the second dielectric layer.

8. The phase shifting apparatus according to claim 7, wherein: a gap is formed between the first dielectric layer and the adjacent first conductor section or between the first dielectric layer and the first tapping element; and a gap is formed between the second dielectric layer and the adjacent first conductor section or between the second dielectric layer and the first tapping element.

9. The phase shifting apparatus according to claim 7, wherein shapes of the first dielectric layer and the second dielectric layer are similar to a shape of the first conductor section.

10. The phase shifting apparatus according to claim 7, wherein thicknesses of the first dielectric layer and the second dielectric layer in a direction that is vertical to a moving plane of the first tapping element, respectively within the range of 0.5 mm to 5 mm.

11. The phase shifting apparatus according to claim 7, wherein the first dielectric layer and the second dielectric layer are made of material whose relative dielectric constant is within a range of 1.5 to 16.

12. The phase shifting apparatus according to claim 1, further comprising a second conductor section and a second tapping element, wherein: the feeder unit is electrically connected to the second tapping element; the second tapping element is electrically connected to the second conductor section;

the second tapping element is capable of moving along the second conductor section to change a phase of a signal that flows through the feeder unit, the second tapping element, and the second conductor section; and the second tapping element implements synchronous moving with the first tapping element through a synchronization apparatus, and moving paths of the second tapping element and the first tapping element do not interfere with each other.

13. The phase shifting apparatus according to claim 12, wherein: the first conductor section is in a strip arc shape, and the first tapping element rotates around the center of a rotation axis to move along the first conductor section; and the second conductor section is in the strip arc shape, and the second tapping element rotates around the center of another rotation axis to move along the second conductor section.

14. The phase shifting apparatus according to claim 13, wherein: the center of the rotation axis of the first tapping element coincides with the center of the rotation axis of the second tapping element;

the synchronization apparatus is a rotation axis that is disposed at the center of the rotation axis of the first tapping element and the second tapping element; and the first tapping element and the second tapping element are disposed on the rotation axis and are capable of rotating around the rotation axis or rotating under driving of the rotation axis.

15. The phase shifting apparatus according to claim 14, wherein:

the second tapping element is disposed at one end where the first tapping element is electrically connected to the first conductor section; and the second conductor section is electrically connected to one end of the second tapping element, wherein the end of the second tapping element is away from the first tapping element.

16. The phase shifting apparatus according to claim 15, wherein the second conductor section is parallel to the first conductor section and at a certain distance from the first conductor section.

17. The phase shifting apparatus according to claim 14, wherein:

the first conductor section and the second conductor section are disposed at an interval along an axial direction of the rotation axis;

the first tapping element and the second tapping element, which correspond to the first conductor section and the second conductor section respectively, are disposed at an interval along the axial direction of the rotation axis; and the feeder unit comprises a first feeder element and a second feeder element, wherein the first feeder unit is electrically connected to the first tapping element, and the second feeder unit is electrically connected to the second tapping element.

18. The phase shifting apparatus according to claim 17, wherein a projection of the first conductor section and a projection of the first tapping element along an extension direction of an axial line of the rotation axis overlap a projection of the second conductor section and a projection of the second tapping element along the same direction.

19. The phase shifting apparatus according to claim 14, wherein the first tapping element and the second tapping element rotate on a same rotation plane, and the rotation plane is vertical to an axial line of the rotation axis.

20. An antenna system, comprising a phase shifting apparatus and radiating units that are electrically connected to the phase shifting apparatus, wherein the phase shifting apparatus comprises a first conductor section, a first tapping element, a feeder unit, and a dielectric element, wherein: the feeder unit is electrically connected to the first tapping element; the first tapping element is electrically connected to the first conductor section; the first tapping element is capable of moving along the first conductor section to change a phase of a signal that flows through the feeder unit, the first tapping element, and the first conductor section; the dielectric element is disposed at a position near the first conductor section and is configured to change a relative dielectric constant near the first conductor section in order to increase an electrical length of the first conductor section; the first conductor section comprises electrical connecting ends that are located on two opposite sides of an electrical connecting area of the first tapping element and the first conductor section; and the radiating units are separately connected to the electrical connecting ends of the first conductor section, wherein the dielectric element is not disposed of in between the first conductor section and the first tapping element.

* * * * *